US005228317A

United States Patent [19]

Hendricks

[11] Patent Number: 5,228,317

[45] Date of Patent: Jul. 20, 1993

[54] GEM CHANGER RING

[75] Inventor: Bennett B. Hendricks, Castro Valley, Calif.

[73] Assignee: Hendricks and Bayhi, a partnership, San Leandro, Calif.

[21] Appl. No.: 991,916

[22] Filed: Dec. 17, 1992

[51] Int. Cl.[5] ..... A44C 9/00

[52] U.S. Cl. ..... 63/15.7; 63/29.1

[58] Field of Search ..... 63/15, 15.2, 15.6, 15.7, 63/29.1; D11/26, 36

[56] References Cited

U.S. PATENT DOCUMENTS

| | | | |
|---|---|---|---|
| D. 309,276 | 7/1990 | Mejias | D11/26 |
| 899,296 | 9/1908 | Elliot | 63/15.7 |
| 1,152,340 | 8/1915 | Obsboum | 63/29.1 X |
| 1,186,271 | 6/1916 | Block | 63/29.1 X |
| 1,326,977 | 1/1920 | Schwartzman | 63/15 |
| 3,115,758 | 12/1963 | Eberle et al. | 63/29.1 X |

FOREIGN PATENT DOCUMENTS

| | | | |
|---|---|---|---|
| 577308 | 9/1924 | France | 63/15.7 |

*Primary Examiner*—Peter M. Cuomo
*Assistant Examiner*—Michael J. Milano
*Attorney, Agent, or Firm*—Owen, Wickersham & Erickson

[57] ABSTRACT

A ring having two shanks which pivot around a pin parallel to the finger holes through the two shanks. One of the shanks has an gem setting receiving hole which receives a center gemstone prong setting when the two shanks are in an open position. When a center gemstone prong setting containing a center gemstone and a prong setting base is introduced into the gem setting receiving hole and the two shanks are moved to their closed position, the escape path for the center gemstone prong setting is blocked and the center gemstone prong setting is locked in place. Locating the pivot pin closely adjacent to the setting provides a significant mechanical advantage to carry loads of large bezels and/or gemstone clusters around a replaceable or interchangeable centered gemstone.

12 Claims, 2 Drawing Sheets

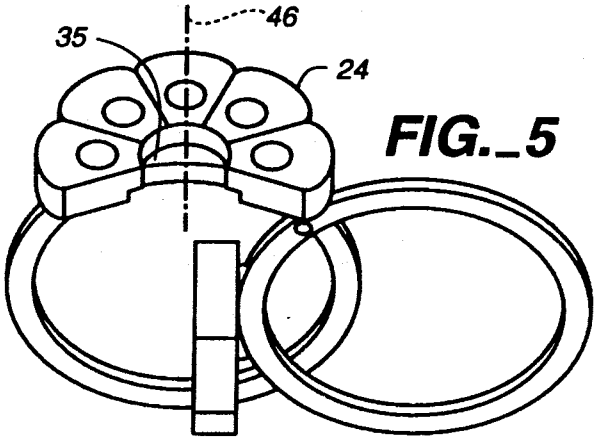
FIG._5
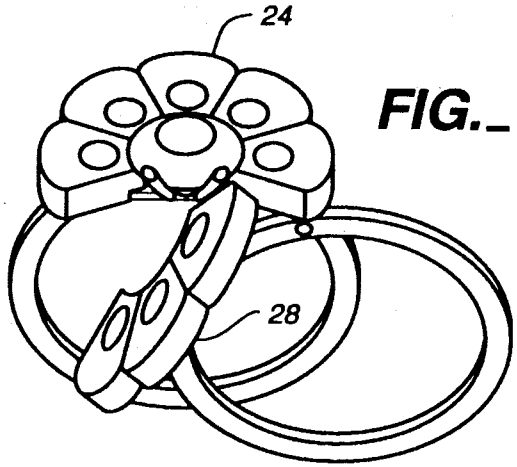
FIG._6
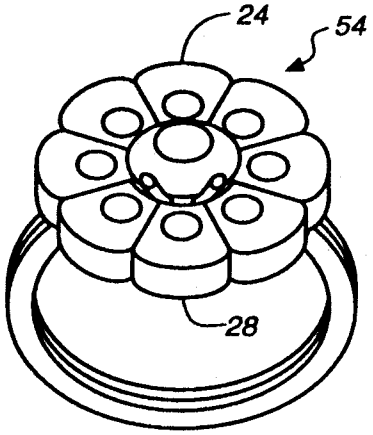
FIG._7
FIG._8
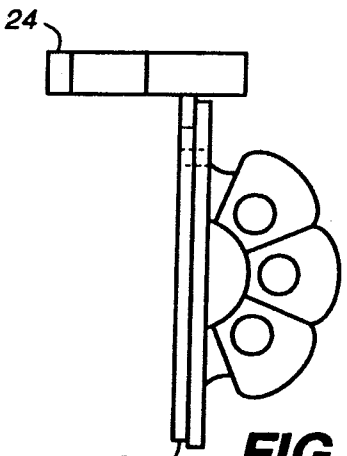
FIG._9
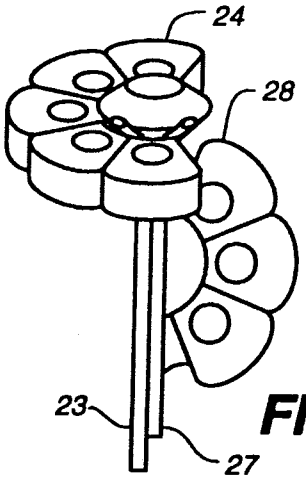
FIG._10
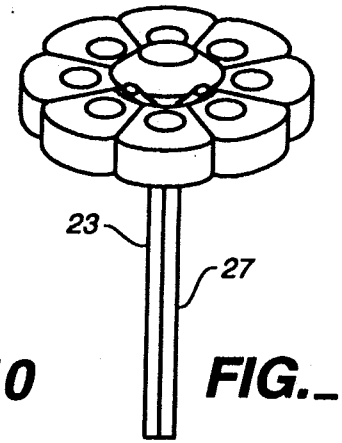
FIG._11

GEM CHANGER RING

BACKGROUND OF THE INVENTION

1. Field of the Invention

This invention relates to the field of jewelry rings with settings of gemstones that can be interchanged.

2. Prior Art

Rings with gemstones or other attractive settings are often used to accentuate a person's style and complement his/her wardrobe. When viewing rings often a gemstone or other attractive object located at the center of the setting draws the most attention and is seen as matching or conflicting with a person's style and/or wardrobe. Changing a gemstone or other settings pieces in rings often require a trip to the jeweler to assure that the new setting or gemstone located at the center of the ring setting is properly secured and arranged in accordance with the wearer's desires. Often a wearer will find the ring attractive, but may wish to change only the center stone or other attractive piece at the center of the ring.

The jewelry industry has recognized this, and there has been an evolution of some rings with interchangeable settings. For instance, by Estrin, U.S. Pat. No. 3,307,375; by Lambert, U.S. Pat. No. 684,272; by Jenkins, U.S. Pat. No. 4,742,696; by Ellison, 3,568,467; and by Gheblikian, U.S. Pat. No. 4,905,482. The difficulty associated with prior art is that there is some hidden or hard-to-manipulate locking mechanism which must be unlocked and opened before the setting or stone can be replaced. Further, prior art which does not depend on some kind of secure locking mechanism is subject to separation during the movement of the ring as when it is worn or if it is accidentally dropped. Also, none of the prior art devices known to the inventor are capable of replacing a center gemstone prong setting which is surrounded by a main bezel with a fairly large gemstone cluster completely surrounding the centrally located gemstone prong setting.

SUMMARY OF THE INVENTION

This invention solves the previously discussed problems by providing a two shank ring configuration where the two shanks are adjacent to one another and pivot around a connecting pin. The first shank has a slot-like hole to receive a base of a gemstone or other setting in it. When the second shank is swung around so that the two shanks' finger holes align, a portion of the second shank blocks the exit path for the base of the gemstone setting and thereby prevents it from coming out of the gem receiving opening in the first shank. With this configuration, it is possible to construct a gemstone cluster around a center setting so that one part of the cluster moves with the second shank while the majority of the cluster remains attached to the first shank around the gem setting receiving hole, such that when the two shanks' finger holes are aligned, the two sections of the gemstone cluster appear to be one continuous single cluster with a gemstone at its center.

The configuration of the gemstone prong base and the gemstone receiving hole in the first shank are such that once the gemstone prong base is inserted into the gem setting receiving hole and the second shank is pivoted around to a closed position, the prong setting base is locked into the gem setting receiving hole and cannot be dislodged unless the second shank is slid away. Therefore, whenever the two shanks are aligned and on a wearer's finger, the gemstone prong setting is securely locked in place. Further, the dimension of the lever arm associated with the dimensions of the shanks create a long lever arm to oppose the short lever arm supporting the section of the gemstone cluster supported by the second shank. This nearly guarantees that the first shank will not be accidentally pivoted away from the second shank to release the gemstone prong setting base along with the gemstone held by it.

A BRIEF DESCRIPTION OF THE DRAWINGS

FIG. 5 shows a perspective top view of the ring shanks open to expose the gem setting receiving hole;

FIG. 6 shows the center gemstone prongs setting in position in the gem setting receiving hole;

FIG. 7 shows the ring shanks in their closed position and the center gemstone prong setting surrounded by the whole bezel;

FIG. 8 shows an end view of the ring;

FIG. 9 shows an end view of the ring with the center gemstone prong/setting absent;

FIG. 10 shows an end view of the ring with the center gemstone prong setting in place; and FIG. 11 shows an end view of the ring with its shanks in their closed positions with the center gemstone prong setting in place.

DETAILED DESCRIPTION

Figure 2:
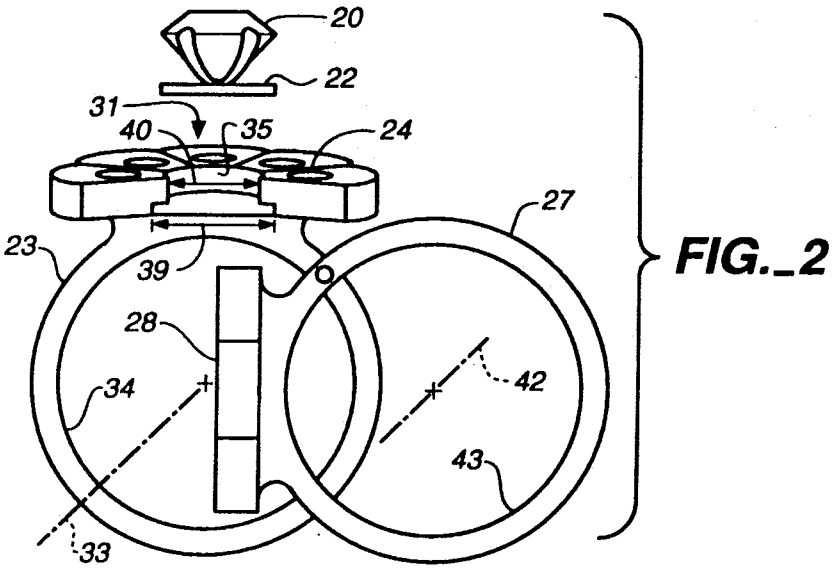
FIG. 2 shows the two ring shanks in an open position exposing the opening to receive the center gemstone prong setting.

An embodiment of the invention is shown in FIGS. 1–11. This embodiment shows a whole bezel 54 (FIG. 7) surrounding a center gemstone prong setting 48 (FIG. 1) that is shown at the center of the bezel 54. The ring has two shanks 23, 27 (FIG. 2). While these shanks 23, 27 are shown as full loops in the drawings, it is possible that each of these shanks might comprise a complementary portion of a full loop and produce a circular loop only in their closed position as shown in FIGS. 1, 4, 7, and 11.

Figure 3:
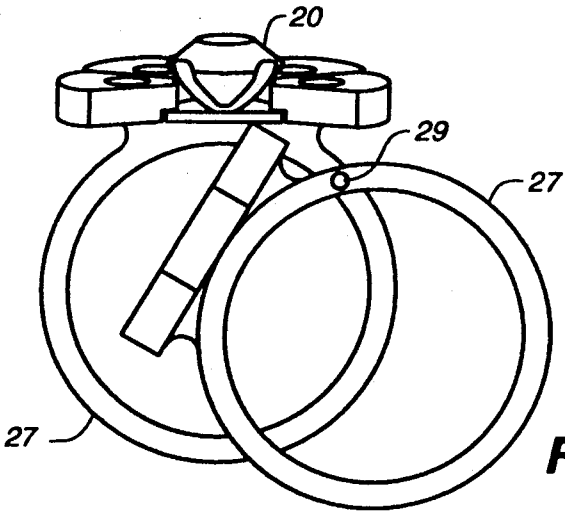
FIG. 3 shows an open position of the ring with the center gemstone prong setting in place.

As shown in FIG. 3, the two shanks 23, 27 are connected by a pin 29. This pin can be separate from or integral with either one of the shanks 23, 27, but must allow the opposite shank to pivot around the pin 29. The pin 29 also acts to maintain the two shanks in close alignment such that the first flat side 37 (FIG. 9) of the first shank 23 is in close or even rubbing contact with the matching face on the second shank 27.

In order to provide interchangeability of the center gemstone prong setting 48 (FIG. 1), the gemstone center prong setting includes a center gemstone 20, a series of center gemstone prongs 21, and a base/flange of the prong setting 22. When, as shown in FIG. 2, the two shanks are pivoted around the pin 29 so that their respective central axes 33, 42 of their respective finger holes 34, 43 are misaligned, the first flat side of 37 of the first shank 23 exposes a portion of the gem setting receiving hole 35 facing the second shank 27. The center gemstone prong setting 48 can include any stone which will fit in prongs 21 which can be attached to a prong setting base 22, whose dimensions are matched to the gem setting receiving hole 35.

The gem setting receiving hole 35 includes at least two width dimensions. A first hole width dimension 39 at a first position in said hole corresponds to a width of the prong setting base 22. A second hole with 40 which is measured at a location farther from the center of the ring than the first hole width 39 and is narrower than the first hole width 39 so that a center gemstone prong setting 48 having a base 22 will fit within the first hole width 39, but will be too large and interfere with the second hole width 40 to prevent the center gemstone prong setting 48 from moving or slipping outward from the center of the ring. The base 22 of the center gemstone prong setting may be round, rectangular, trapezoidal, triangular, or any other similar shape which provides an interference preventing the center gemstone prong setting 48 from moving outward from the center of the first shank from the gem setting receiving hole 35.

Figure 4:
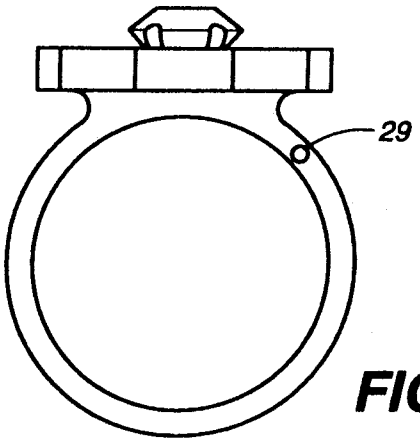
FIG. 4 shows the ring with its shanks in their closed positions with the center gemstone prong setting in place.
Figure 1:
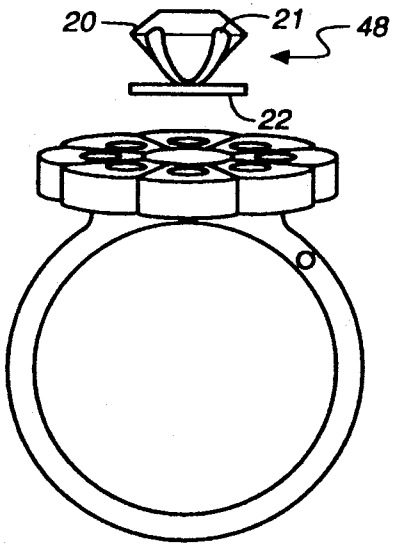
FIG. 1 shows a side view of the ring with the center gemstone prong setting separate from the ring.

When the center gemstone prong setting 48 is put in position, the second shank 27 is pivoted around the pin 29 to its closed position as shown in FIG. 4. This locks the center gemstone prong setting 48 in position, thereby preventing it from moving in any direction out of the gem setting receiving hole 35.

As shown in FIG. 5, the gem setting receiving hole 35 may have a longitudinal axis 46 and appear to be slot-like. While it is preferred that this slot would be parallel to the central axes of the two shanks 33, 42, slight variations from parallel are tolerable as long as the center gemstone prong setting 48 has a correspondingly configured base 22.

The ring shown in FIGS. 1 through 11 is shown with a large bezel surrounding the center gemstone. Because of the mechanical advantage provided by placing the pin 29 closely adjacent to the center of the gemstone setting (a large mechanical advantage is provided by the dimensions of the lever arms on each side of the pivot pin 29 when the two shanks are placed in their closed position as shown in FIGS. 1, 4, 7, and 11). The ring shanks, when worn by a wearer, will impose very little force on a wearer's finger, even if the pin 29 were only to hold the two shanks 23, 27 together in a loose manner. It is preferred that the pin 29 be a rivet or another pivot connecting means which holds the two shanks 23 and 27 tightly together so that there is a rubbing friction between the two shanks to maintain/hold the two shanks in whatever position they are placed. This holding force will provide sufficient frictional resistance such that when the two shanks are in their closed position and the ring is dropped, the two shanks will not pivot relative to one another around the pin 29. A mechanical advantage provided by the location of the pin 29 and the lever action of the second shank 27 as it pivots around the pin 29 allows the ring to be constructed with a large bezel with a large cluster of gemstones around the central stone without any detrimental mechanical or aesthetic effects.

As shown in FIGS. 1 through 4, the whole bezel 54 (FIG. 7) includes a main bezel 24 attached to shank 23 which extends out beyond the first flat side of 37 of said first shank, and when the surrounding gemstone cluster is composed of pie-shaped pieces or leaf-shaped pieces, the separation between the minor bezel 28 and the main bezel 24 is hard to locate without close inspection.

Some stones and metals used in jewelry practice have a high density and would tend to cause the two bezels to separate, but because of the configuration of the two shanks 23 and 27 whenever the ring is on a wearer's finger, there will be no possibility that the shanks will separate and any pressure, due to this tendency to separate, on the wearer's finger will be very small.

While the embodiment shown in FIGS. 1 through 11 shows a large bezel surrounding the center gemstone setting, a bezel need not be provided to utilize this invention. Any reasonably aesthetic configuration where the gem setting receiving hole edges can be camouflaged by the surrounding design would find this invention highly effective.

While the invention has been described with regard to specific embodiments, those skilled in the art will recognize that changes can be made in form and detail without departing from the spirit and scope of the invention.

I claim:

1. A ring comprising:

a first ring shank having a setting located at one position on a periphery thereof, said first shank having a first shank central axis central to a first shank finger hole, said setting including a gem setting receiving hole open to both an outside of said ring and open to a first flat side of said first shank ring, a cross section of said gem setting receiving hole viewed from a point along said first shank central axis above said first flat side of said ring includes a first hole width at a first location within said hole, and a second hole width located outward from said first hole width, said second hole width being narrower than said first hole width;

a second ring shank having a second shank central axis central to a second shank finger hole, said second ring shank being adjacent to said first ring shank; and a pin generally parallel to said first shank central axis and said second shank central axis connecting said first ring shank and said second ring shank, said pin being configured so as to allow said first ring shank to pivot relative to said second ring shank around said pin;

wherein, when said first ring shank and said second ring shank are disposed so that said first shank central axis and said second shank central axis generally coincide, considered to be a closed position, a portion of said second ring shank covers said first flat side of said gem setting receiving hole.

2. A ring as in claim 1, wherein when said first ring shank and said second ring shank are in their closed position, said second ring shank completely covers the gem setting receiving hole on the first flat side of said first shank.

3. A ring as in claim 1, wherein a longitudinal axis of said gem setting receiving hole is generally parallel to said first shank central axis.

4. A ring as in claim 1, wherein a cross section of said gem setting receiving hole is generally uniform along a longitudinal access of said gem setting receiving hole.

5. A ring as in claim 1, wherein said pin is located generally adjacent to said setting location.

6. A ring as in claim 1, further comprising a central gemstone prong setting having a prong setting base whose configuration generally matches the configuration of said gem setting receiving hole, such that when said prong setting base is inserted in said gem setting receiving hole from said first flat side of said first shank, said prong setting base cannot be removed through said opening to the outside of said ring.

7. A ring as in claim 1, wherein said setting includes a main bezel with a first partial gemstone cluster generally surrounding a portion of said gem setting receiving hole opening to the outside of said ring;

wherein said second ring shank includes a minor bezel with a second partial gemstone cluster, said main bezel and said minor bezel when aligned form a whole bezel to generally surround said opening to the outside of said ring from said gem setting receiving hole;

said main bezel and said minor bezel being configured on their respective shanks in locations such that when said first shank and the second shank are in the closed position, said main bezel and said minor bezel are aligned to form said whole bezel.

8. A ring as in claim 7, wherein when said first ring shank and said second ring shank are in the closed position, said second ring shank completely covers the gem setting receiving hole on the first flat side of said first shank.

9. A ring as in claim 7, wherein a longitudinal axis of same gem setting receiving hole is generally parallel to said first shank central axis.

10. A ring as in claim 7, wherein a cross section of said gem setting receiving hole is generally uniform along a longitudinal axis of said gem setting receiving hole.

11. A ring as in claim 7, wherein said pin is located generally adjacent to said setting location.

12. A ring as in claim 7, further comprising a center gemstone prong setting, having a prong setting base whose configuration generally matches the configuration of said gem setting receiving hole, such that when said prong setting base is inserted in said gem setting receiving hole from said first flat side of said first shank, said prong setting base cannot be removed through said opening to the outside of said ring.

* * * * *